4/23/85 XR 4,513,204

United States Patent [19]

Domnanovich et al.

[11] Patent Number: 4,513,204

[45] Date of Patent: Apr. 23, 1985

[54] HOUSING FOR A RADIOACTIVE SOURCE

[75] Inventors: James R. Domnanovich, Roselle; William D. Erwin, Prospect Heights, both of Ill.

[73] Assignee: Siemens Gammasonics, Inc., Des Plaines, Ill.

[21] Appl. No.: 412,224

[22] Filed: Aug. 27, 1872

[51] Int. Cl.[3] ..... G21F 5/02

[52] U.S. Cl. ..... 250/496.1; 250/506.1

[58] Field of Search ..... 250/496.1, 498.1, 506.1, 250/515.1; 378/120

[56] References Cited

U.S. PATENT DOCUMENTS 2,700,111 1/1955 Jacobs et al. ..... 250/498.1

FOREIGN PATENT DOCUMENTS 53999 11/1967 Poland ..... 250/515.1

OTHER PUBLICATIONS

U.S. Patent Application Serial Number 324,090, filed by Mark W. Groch and James T. Rhodes, under the title "Motion Correction Circuitry and Method for a Radiation Imaging Device", on Dec. 1, 1981.

*Primary Examiner*—Bruce G. Anderson

*Attorney, Agent, or Firm*—Mark H. Jay

[57] ABSTRACT

The radioactive structure comprises a radioactive source surrounded by a housing. The housing contains a first and second shielding body and a connecting device. The first shielding body has a protrusion which contains a first recess for receiving the radioactive source. The second shielding body has a second recess in one face end which accommodates the protrusion and a conical aperture communicating with the second recess in another face end. The connecting device connects the first shielding body to the second shielding body. When the radioactive source is inserted into the first recess and when the protrusion is located in the second recess, the radioactive source emits radiation primarily through the conical aperture into the environment. The source preferably contains americium which emits gamma radiation. The structure may be used as a motion correction sensor or as a marker in nuclear diagnostic imaging.

11 Claims, 7 Drawing Figures

HOUSING FOR A RADIOACTIVE SOURCE

BACKGROUND OF THE INVENTION

1. Field of the Invention

This invention generally relates to the field of nuclear medicine. In particular, it relates to the field of radiation diagnosis and to examinations of a patient by means of a scintillation camera. Still more particularly, this invention relates to a housing or container for carrying a radioactive isotope which housing is to be attached to the patient's body, the isotope thereby serving as a motion detector or as an anatomical marker for nuclear images.

2. Description of the Prior Art

In nuclear medicine, a radioactive tracer such as technicium is administered to a patient undergoing examination, and the distribution of the tracer in the patient's body is viewed by aid of a scintillation camera.

A problem associated with this kind of nuclear examination is the movement of the patient. When the patient moves during examination, a blurred image may result.

In order to overcome this disadvantage, a diagnostic motion correction scheme has been developed, see U.S. patent application Ser. No. 324,090, filed by Mark W. Groch and James T. Rhodes, under the title "Motion Correction Circuitry and Method for a Radiation Imaging Device", on Dec. 1, 1981. The disclosure of this application is incorporated herein by reference.

According to this motion correction scheme, a blurring of e.g. $^{99m}$Tc gated blood pool images due to patient motion is corrected. This is accomplished by introducing a special radioactive point source, in particular a gamma ray emitting radioisotope, whose energy window lies outside that of $^{99m}$Tc, into the field-of-view of the scintillation camera. The point source remains outside of the patient's body; thus, no gamma rays emitted from the source are scatter events. Then the centroid of the point source is monitored. When a change in the centroid of the point source is detected due to patient motion, the $^{99m}$Tc events are corrected and repositioned to take into account the motion artifact. In cardiac studies, for instance, the movement of a special radioactive source which is fixed to the chest of the patient is detected. This movement is subtracted from the detected radiation coming from the tracer isotope of different energy signature flowing in the blood through the heart. Thus the "dual isotope motion correction scheme" eliminates the motion blur in the images as they are acquired.

There are two problems that one must keep in mind when using such a centroid (point) source external to the patient's body during image acquisition. First, the special radioactive point source must be within the field-of-view and the events emitted must be detected through the collimator of the camera. Second, since the point source should be encased in a shielding medium which will attenuate $^{99m}$Tc events emanating from the patient's body, the point source must not obstruct any important anatomical structures in the field-of-view.

SUMMARY OF THE INVENTION

1. Objects

An object of this invention is to provide a housing for a radioactive point source which is to be attached to a patient in nuclear medical examinations.

Another object of this invention is to provide such a housing which reliably retains and shields the point source, but leaves an opening free for emission of radiation towards a radiation detection system such as a scintillation camera.

Still another object of this invention is to provide a housing for a radioactive point source which can be used in routine nuclear examinations either as a motion detector or as an anatomical marker for nuclear images.

2. Summary

According to this invention, a housing for a radioactive source comprises a first shielding body, a second shielding body, and connecting means for connecting the two bodies. The first shielding body has a protrusion which contains a first recess for inserting the radioactive source. The second shielding body has a second recess in its surface. The second recess is shaped so that the protrusion fits therein. When the radioactive source is inserted into the first recess and the protrusion is located in the second recess, the radioactive source will emit radiation into the environment primarily through the conical aperture.

According to a preferred embodiment, a $^{241}$Am centroid source is encased in a disk shaped tungsten alloy holder. The bottom part of the disk is to be laid on the patient so that the top part which contains the gamma ray escape aperture, faces away from the patient's body. The escape aperture is cone-shaped at an angle of e.g. approximately 120° with an exit hole of approximately 2 mm.

The first of the two aforementioned problems is solved by insuring that the source is in the field-of-view and that the disk holder not be tilted by more than 60° from a plane perpendicular to the collimator holes.

The second of the aforementioned two problems has a different solution depending on the view and collimator used in imaging.

1. RAO with slant hole collimator: The point source should be placed anatomically below the heart and just to the left side of the chest wall center.

2. ANT with parallel hole collimator: The point source should be placed anatomically anywhere below the heart, as long as the source faces anteriorly.

3. LAO with parallel hole collimator: The point source should be placed anatomically below the heart and on the central left to far left side of the chest wall.

Adhesion of the centroid point source to the patient is preferably accomplished by placement of surgical tape in an X-pattern over the top side of the source, adhering the source firmly to the patient, thus insuring that patient and source motion is unified.

The foregoing and other objects, features and advantages of the invention will be apparent from the following more particular description of preferred embodiments of the invention, as illustrated in the accompanying drawings.

DETAILED DESCRIPTION OF THE PREFERRED EMBODIMENTS

Figure 1:
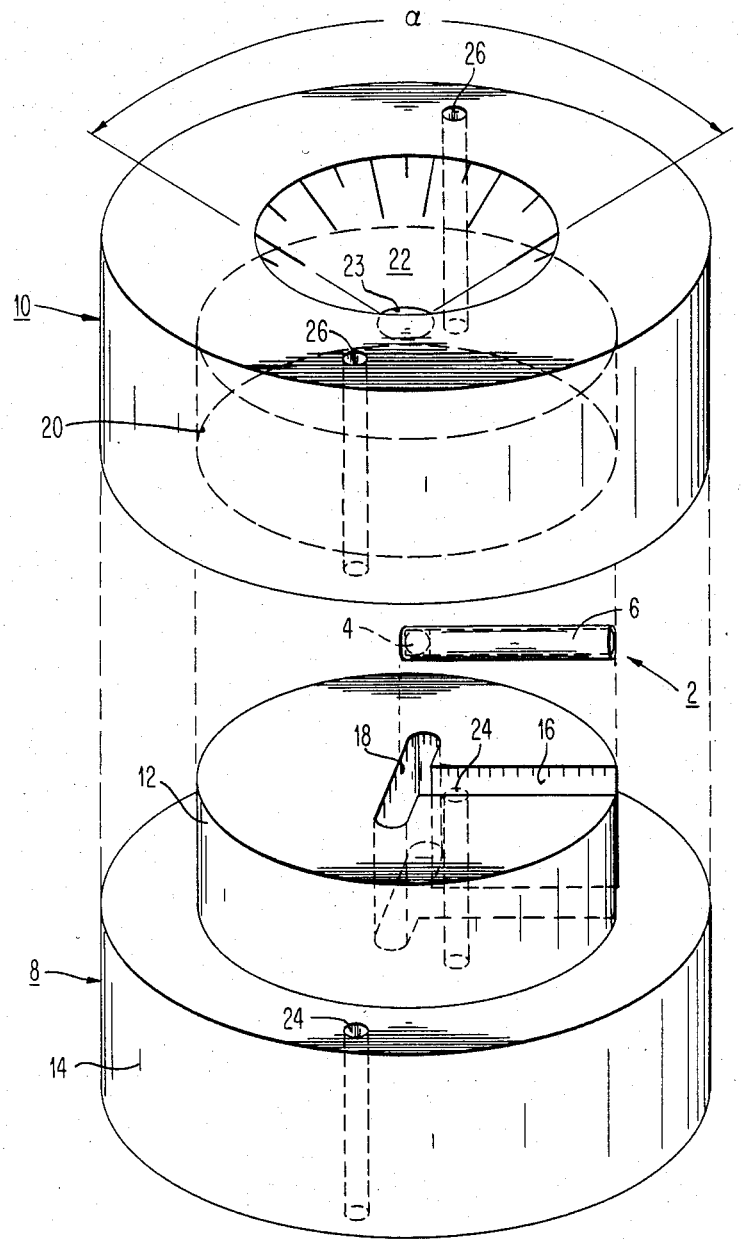
FIG. 1 is an exploded perspective view of a centroid source holder according to the invention, in an enlarged scale.
Figure 2:
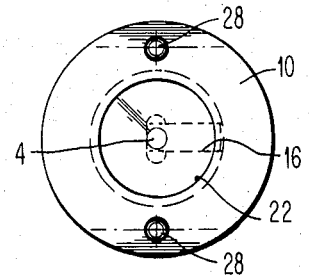
FIG. 2 is a plane view of the assembled source holder illustrated in FIG. 1.

In FIGS. 1–7, a holder, container or housing containing or carrying a radioactive source 2 is illustrated. The source 2 comprises a radioactive isotope which is used in a diagnostic motion correction scheme. Thus, the housing may be termed a dual isotope motion correction centroid point source holder. In the present case, the source 2 is commercially available for nuclear medicine purposes. In particular, it is a gamma radiation source available from The Radiochemical Centre, Amersham, England. A 2 mm diameter spherical point source 4 is located at one end of a closed-end cylindrical stainless steel housing 6 of 3 mm diameter and 10 mm length. The other end of the source housing 6 is plugged with an approx. 8 mm long stainless steel plug. The point source 4 is a pellet or bead containing the radioactive isotope. For motion correction applications, preferably an americium source is used.

The radioactive material americium 241 has a comparatively low energy with regard to the emitted gamma radiation. This energy differs markedly from the energy of gamma radiation emitted by a tracer which is conventionally administered to a patient in nuclear medicine. The half-life of americium is several hundred years. This has the advantage that during patient examination and during the lifetime of a scintillation camera, a replacement of the radiation source 2 is not necessary.

An americium point source can also be used as a marker in nuclear imaging by means of a scintillation camera such as the Anger camera.

The housing contains a lower or bottom part 8 and an upper or top part 10. Both parts or sections 8 and 10 are made of a shielding material, preferably of a metal. A compound containing tungsten is preferred. A tungsten alloy known as "Mallory 1000" has been found especially useful. The holder sections 8 and 10 are of a material containing tungsten rather than lead because of its durability and its lighter weight. However, also other radiation attenuating materials may be used.

The bottom part 8 represents a first radiation shielding body. As can be seen in FIG. 1, it contains at its upper end a protrusion 12. The protrusion 12 and the base portion 14 of the bottom part 8 are both of cylindrical or disk shape. The protrusion 12 contains a first recess or chamber 16 for holding the cylindrical source housing 6 containing the radioactive americium source 4 therein. In particular, the first recess 16 is a channel extending from the periphery of the cylindrical protrusion 12 to its middle section. Here it merges into another channel or chamber 18 which is arranged perpendicularly thereto. The channels 16 and 18 are shaped so that the point source 4 becomes positioned in the center of the disk structure 8. Both channels 16, 18 extend from the upper face end of the protrusion 12 to the upper end of the base portion 14. In operation, the source 2 is kept in the channel 16 by means of a cement.

The top part 10 represents a second radiation shielding body. On its lower end it contains a second recess 20 which is illustrated in FIG. 1 in broken lines. The recess 20 as well as the top part 10 have a cylindrical or disk shape. The dimension of the second recess 20 is such that the protrusion 12 of the bottom part 8 fits tightly therein. In the upper surface of the upper part 10 is provided a conical recess 22. The conical angle of this recess 22 is designated by $\alpha$. The recess 22 merges into a central aperture 23 connecting the upper recess 22 with the lower recess 20. The diameter d of the central aperture 23 is preferably $d=2$ mm, see FIGS. 4 and 5. The aperture 23 and the recess 22 are provided for permitting the passage of radiation quanta from the point source 4 at angles between 0° and 60° towards the upper surface.

Figure 3:
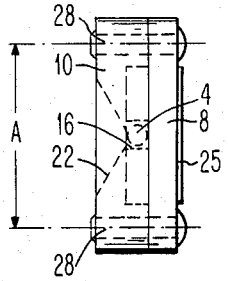
FIG. 3 is a side view of the assembled source holder illustrated in FIG. 1.
Figure 4:
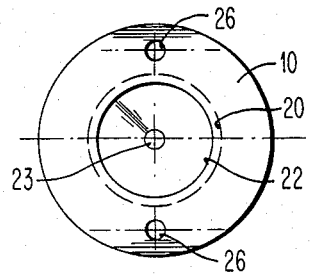
FIG. 4 is a plane view of the top of the source holder illustrated in FIG. 1.
Figure 5:
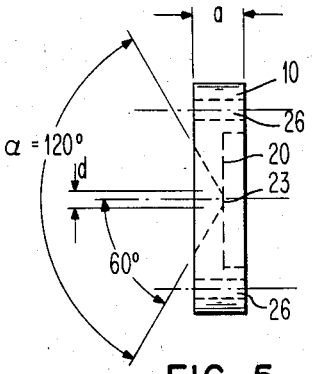
FIG. 5 is a side view of the top of the source holder illustrated in FIG. 1.
Figure 6:
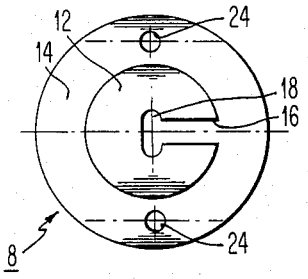
FIG. 6 is a plane view of the bottom of the source holder illustrated in FIG. 1.
Figure 7:
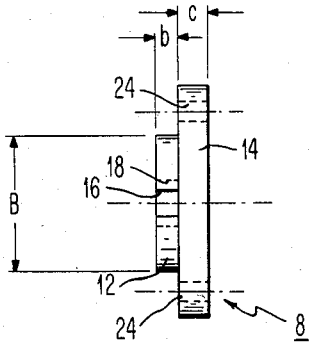
FIG. 7 is a side view of the bottom of the source holder illustrated in FIG. 1.

To the lower end of the lower part 8, there may be attached a label 25, see FIG. 3. This label 25 contains information such as radiation identification and a caution note.

There are also provided means for connecting the top part 10 to the bottom part 8. These means comprise two openings 24 extending axially through the bottom part 8 and two openings 26 extending axially through the top part 10. These openings 24, 26 are provided at the rim portions of the parts 8 and 10, respectively, and they are aligned with respect to each other. The connecting means may further comprise rivets 28, extending through the openings 24 and 26 as illustrated in FIG. 3. Thus, in the preferred embodiment the parts 8 and 10 are kept together by the rivets 28 running through boxes at diagonally opposite sides of the parts 8 and 10.

During assembly of the structure, the radiation source 2 is inserted and cemented into the first recess 16 and subsequently the protrusion 12 is plugged into the second recess 20. Now the lower end face of the upper part 10 joins the upper end face of the bottom portion 14. Then the top part 10 is connected to the bottom part 8 by means of the aforementioned rivets 28. In the closed status of the parts 8 and 10, the radioactive source 2 will emit gamma radiation basically through the conical aperture 22. The centroid source holder may now be attached to the patient. The openings 22, 23 in the center of the upper part 10 serve as a port to pass the emitted radiation from the point source 4 towards the scintillation camera.

After assembly, the upper and lower parts 8, 10 both enclose the source 2 in a tight manner. The point source 4 is completely encapsulated with the exception of the area where the aperture 23 and the conical recess 22 are provided. Due to this feature, an optimum shielding of the patient and of the technician or physician performing the examination is achieved.

Examinations have proven that a wide range of conical angles $\alpha$ can be used. However, an angle of approximately $\alpha=120°$ has proven to be best for certain applications. This angle $\alpha$ is especially useful if a movable scintillation camera is used. It ensures that the scintillation camera exerts a constant count rate at various positions of the camera with respect to the housing 8, 10.

In order that the angle $\alpha$ can be used optimally, the height b of the protrusion 12 should not markedly exceed the diameter of the source 2.

Thus, the 120° angle is empirically chosen. It allows for angular placement of the camera head relative to the source. Yet it is not too wide an angle to prevent shielding of the radiation from the patient and surrounding environment (nurses, etc.). A vertical walled opening would not permit many counts to reach the camera head if the head is placed at an angle because the parallel collimator would not accept rays at angles to the axes of the collimator paths.

The size of the container is small so that it can be easily taped, e.g. to the chest of a patient by a surgical tape. It will move with the movement of the patient's chest. In a preferred embodiment, the container dimensions are A=2.5 cm; B=1.9 cm; a=7 mm; b=3 mm; c=4 mm.

While the forms of the housing for a radioactive source herein described constitute preferred embodiments of the invention, it is to be understood that the invention is not limited to these precise forms of assembly, and that a variety of changes may be made therein without departing from the scope of the invention.

What is claimed is:

1. A housing for a radioactive source which is to be attached to a patient, comprising in combination:

(a) a first shielding body having a protrusion, said protrusion containing a first recess for inserting said radioactive source therein, (b) a second shielding body having (b1) a second recess in the surface thereof, said second recess having a shape such that said protrusion fits therein, and (b2) a conical aperture communicating with said second recess, said radioactive source emitting radiation through said conical aperture when said source is inserted into said first recess and when said protrusion is located in said second recess; and (c) connecting means for connecting said first shielding body to said second shielding body when said radioactive source is inserted into said first recess and when said protrusion is located in said second recess, said radioactive source thereby emitting radiation into the environment primarily through said conical aperture.

2. The housing according to claim 1, wherein said first and second shielding bodies are of cylindrical shape.

3. The housing according to claim 1, wherein said protrusion and said second recess are of cylindrical shape.

4. The housing according to claim 1, wherein said conical aperture has a cone angle of approximately 120°.

5. The housing according to claim 1, wherein said first and second shielding bodies comprise a metal.

6. The housing according to claim 5, wherein said metal contains tungsten.

7. The housing according to claim 1, wherein said radioactive source contains americium.

8. The housing according to claim 1 for a radioactive source having the form of an elongated rod, one end of said rod containing a radioactive substance, comprising a channel-shaped first recess in said first shielding body for mounting said radioactive source therein.

9. The housing according to claim 8, wherein said protrusion and said second recess are of cylindrical shape, wherein said channel-shaped first recess is open at one end, and wherein said rod end containing said radioactive stubstance is located in the central portion of said cylindrical protrusion.

10. The housing according to claim 9, wherein said channel-like first recess merges into a channel-like third recess located in the central portion of said cylindrical protrusion.

11. The housing according to claim 1, wherein said second shielding body has a first end face and a second end face opposite to said first end face, wherein said second recess is provided in said first end face, and wherein said conical aperture is provided in said second end face.

* * * * *

UNITED STATES PATENT AND TRADEMARK OFFICE

CERTIFICATE OF CORRECTION

PATENT NO. : 4, 513, 204

DATED : April 23, 1985

INVENTOR(S) : James R. Domnanovich and William D. Erwin

It is certified that error appears in the above—identified patent and that said Letters Patent is hereby corrected as shown below:

On the title page;

The filing date of this application is August 27, 1982.

Signed and Sealed this

*Twenty-seventh* Day of *August 1985*

[SEAL]

*Attest:*

DONALD J. QUIGG

*Attesting Officer* *Acting Commissioner of Patents and Trademarks*